US005247752A

United States Patent [19]

Gyr et al.

[11] Patent Number: 5,247,752

[45] Date of Patent: Sep. 28, 1993

[54] FOLDABLE BAG DRYER

[76] Inventors: Kaj Gyr, 1807 NE. 52nd Ave., Portland, Oreg. 97213; Barbara J. Thoman, 2157 Roblyn Ave., St. Paul, Minn. 55104

[21] Appl. No.: 668,932

[22] Filed: Mar. 13, 1991

[51] Int. Cl.[5] ..... F26B 25/00

[52] U.S. Cl. ..... 34/239; 34/104; 211/196

[58] Field of Search ..... 34/151, 239, 240, 243 R, 34/104; 211/195, 196, 197, 205; 248/95

[56] References Cited

U.S. PATENT DOCUMENTS

| | | | |
|---|---|---|---|
| 1,563,137 | 11/1925 | Amsler | 34/239 |
| 3,295,694 | 1/1967 | Nejezchleb et al. | 211/126 |
| 3,626,602 | 12/1971 | Glowacki | 34/239 |
| 3,798.788 | 3/1974 | Kuntz | 34/239 |
| 4,856,206 | 8/1989 | Klein | 34/239 |

FOREIGN PATENT DOCUMENTS

| | | | |
|---|---|---|---|
| 1204616 | 11/1965 | Fed. Rep. of Germany | 34/239 |
| 785725 | 8/1935 | France | 34/239 |
| 1187604 | 4/1970 | United Kingdom | 34/239 |

*Primary Examiner*—Henry A. Bennet
*Assistant Examiner*—Denise L. Gromada

[57] ABSTRACT

A Foldable Dryer which includes a stem that defines a vertical axis, a plurality of hangers which radiate outwardly from the stem, and a one-piece dilator ring with plural holes for receiving each hanger. A central hinge is located towards the base of the stem and connects the hangers to the stem. The holes in the dilator ring are generally frusto-conical and arranged in a circular pattern around a central hole that receives the stem. The dilator ring is slideable with respect to the stem and hangers. This allows the top portions of the hangers to unfold outwardly from the stem, while being compact and limiting the amount of necessary pieces, moving or stationary. When the hangers are unfolded and the dilator ring is in its low position, the hangers approximate the shape of an inverted cone. The dryer may be supplied with a base and/or be hung from it's uppermost end. It may also be attached to a vertical surface with suction cups or other fasteners.

1 Claim, 5 Drawing Sheets

16. DILATOR RING

FOLDABLE BAG DRYER

BACKGROUND

1. Field of Invention

This invention relates to the development of Bag Dryers, specifically to a new foldable bag dryer which promotes the reuse of plastic bags by providing an easy means of air-drying them after they are washed.

2. Description of Prior Art

Many plastic bags can be reused if you wash them. Washing them appears to be the easy part, however. Despite a commitment to waste reduction, many people give up on reusing plastic bags when their countertops or dish drainers become an ugly morass of wet plastic bags. Aside from being an aesthetic concern, the inadequate drying of plastic bags poses a potential health risk, as it creates an environment conducive to the proliferation of pathogenic bacteria.

Our patent search disclosed only one rack designed for air-drying plastic bags. U.S. Pat. No. 3,295,694 issued to Nejezchleb (1967) shows a drying rack comprised of a series of bag supporting extensions set in a row above a water gathering tray. This system requires extra counter space, and is very bulky, hard to store, difficult to clean, non-foldable, and relatively unattractive. Furthermore, it doesn't allow for adequate circulation of air between each bag.

OBJECTS AND ADVANTAGES

Accordingly, some objects and advantages of our present invention include:

(a) the provision of a Bag Dryer which is compact and easy to store.

(b) the provision of a Bag Dryer which is aesthetically pleasing—one which mixes form and function.

(c) the provision of an adjustable Bag Dryer.

(d) the provision of a Bag Dryer which can be used with many sizes of bags.

(e) the provision of a Bag Dryer which can be either hanging or freestanding.

(f) the provision of a Bag Dryer which can be made from a variety of materials, while retaining its original form.

BRIEF DESCRIPTION OF DRAWINGS

FIG. 18 shows a top view of the Retainer Ring for embodiment 4a.

REFERENCE NUMERALS IN DRAWINGS

10: Ring (Releasable Means for Hanging)
12: Hangers
14: Stem
16: Dilator Ring (Securing Means)
18: Radiating Hinge
20: Base (Stable Means Of Supporting)
22: Holes for Hangers
24: Spreaders
26 Eyelets
28: Central Hinge (Hinging Means for Interconnecting)
29: Peripheral Hinge
30: Removable Block Base
32: Removable Folding Base
36: Flexible Hanger Attachment
38: Retainer Ring
40: Swivel Hinge (Swiveling Means for Pivotally Attaching)
42: Flexible Supporting Means
44: Brass Screws

DESCRIPTION—FIGS. 1-25

Figure 1:
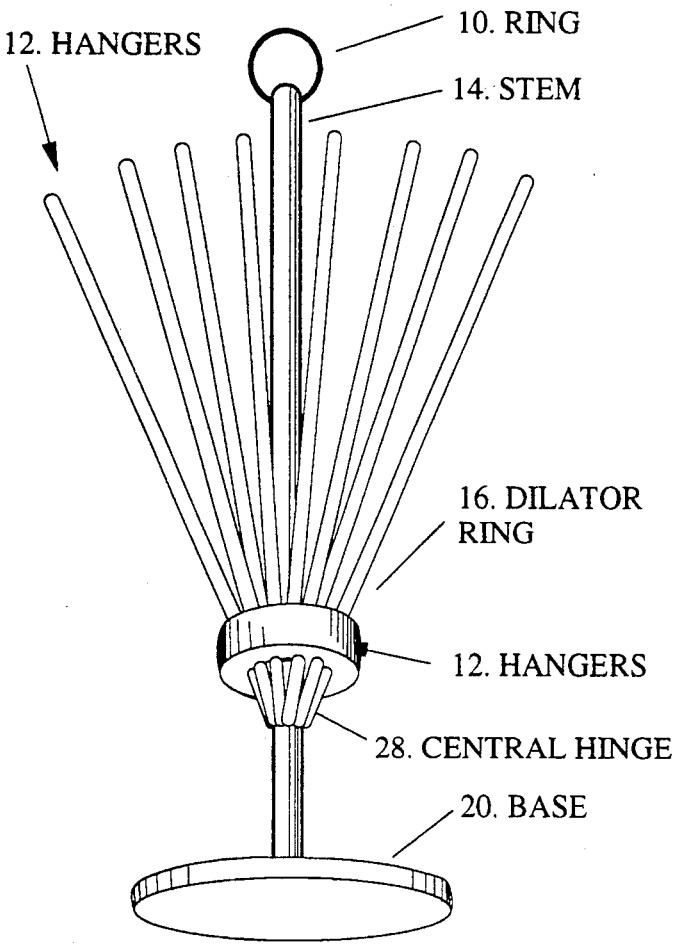
FIG. 1 shows a perspective view of embodiment 1.
Figure 2:
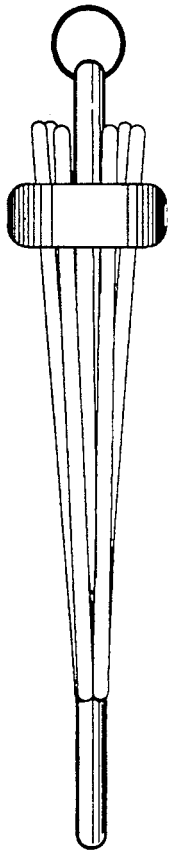
FIG. 2 shows a side view of embodiment 1 folded and with the base removed.

A typical embodiment of the foldable bag dryer is illustrated in FIG. 1. An elongated Stem 14 defines a central vertical axis. Positioned around and parallel to the Stem 14 are 4-12 elongated Hangers 12, having ends that are proximal and distal to the axis. A securing means, or Dilator Ring 16 associated with the Hangers is slideable along the Stem 14 and Hangers 12 toward the Central Hinge 28, or hinging means for interconnecting the hangers.

The Stem 14 can be from 6-16 inches long, and is generally ¼ to ½ inch in diameter. The Hangers 12 may be 8-14 inches in length, and of a smaller diameter than the Stem 14. When unfolded, the hangers form a relatively large circular pattern at the distal or top ends, and a relatively small circular pattern at the proximal or bottom ends.

Figure 3:
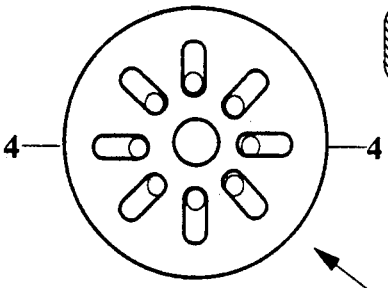
FIG. 3 shows a top view of the Dilator Ring for embodiment 1.
Figure 4:
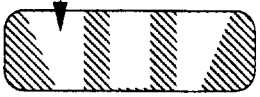
FIG. 4 is a side sectional view taken along the line 4—4 of FIGS. 3 and 5.
Figure 5:
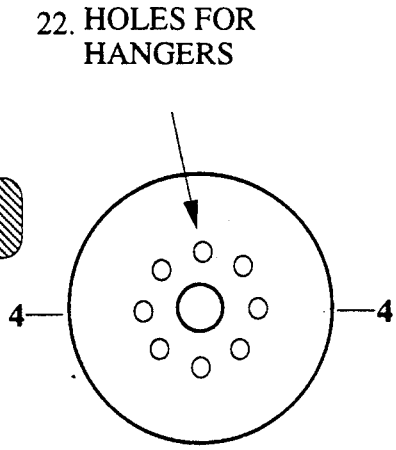
FIG. 5 shows bottom view of the Dilator Ring for embodiment 1.

The Dilator Ring 16, as shown in FIG. 3, serves as a securing means for the Hangers 12, yet allows them to be folded. There are many different configurations that the Dilator Ring 16 may take, but in its simplest form it's disc-shaped and is roughly ½ inch thick and 2 inches in diameter. It has a hole for the Stem 14 in its center, and a plurality of oblong frusto-conical Holes for Hangers 22 placed parallel to the vertical axis. These Holes for Hangers 22 number anywhere from 4-12, depending on the number of Hangers 12. They're drilled into the Dilator Ring 16 such that they allow the Hangers 12 to slide through them, but increase the angle of the Hangers 12 in relation to the Stem 14 when the Dilator Ring 16 is slid down the Stem 14 toward the Central Hinge 28. Each hole is defined by a medial and lateral surface. The medial surface is generally vertical, while the lateral surface angles outwardly from the vertical. The hole is thus circular on the bottom of the Dilator Ring 16, but becomes oblong outwardly at the top of the Dilator Ring 16 while maintaining the same bore, as shown in FIGS. 3 and 4. When the Hangers 12 are unfolded outwardly, each of them is supported against the lateral surface of these frustoconical holes.

Figure 8:
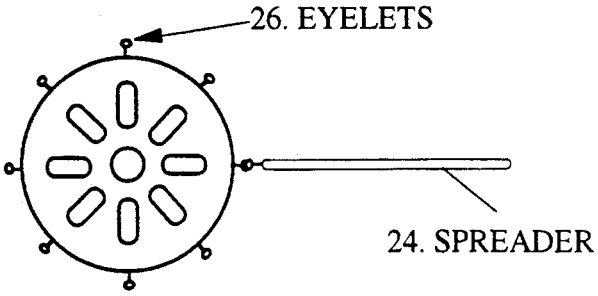
FIG. 8 shows a top view of a Dilator Ring for embodiment 2 with Eyelets and a Spreader Attached.

The Central Hinge 28 comprises a hinging means for interconnecting the proximal ends of the Hangers. In our prototypes we fashioned holes through the proximal end of each of the Hangers 12 and passed a copper wire through them. This wire was then attached to the Stem 14 via holes drilled through the Stem 14. As such, the Hangers 12 form a circle around the Stem 14, and hinge outwardly parallel to the radii of the Stem 14 from this fixed point. Eyelets affixed to the perimeter of the stem and the bottom end of each hanger would work also, as shown in FIG. 8. A removable Base 20 may be included, as shown in FIG. 1.

The angle of the Hangers 12 should be approximately 30–60 degrees from the Stem 14 when they are unfolded outwardly. Regardless of how far down the Stem 14 the Central Hinge 28 has been placed, the Stem 14 should extend below the Central Hinge 28 far enough to allow for the hanging of bags if the Bag Dryer incorporates a base. A distance of 3–4 inches will generally suffice, depending on how long the Hangers 12 are. Depending on the length of the Stem 14, it may be necessary to attach a stop of sorts to the Stem 14 in order to prevent the Dilator Ring 16 from slipping off the ends of the Hangers 12. The Ring 10 itself may performs this function, or, if the Stem 14 extends pass the ends of the Hangers 12, a dowel or copper wire can be passed through it at a point towards the top of the Hangers 12.

Figure 6:
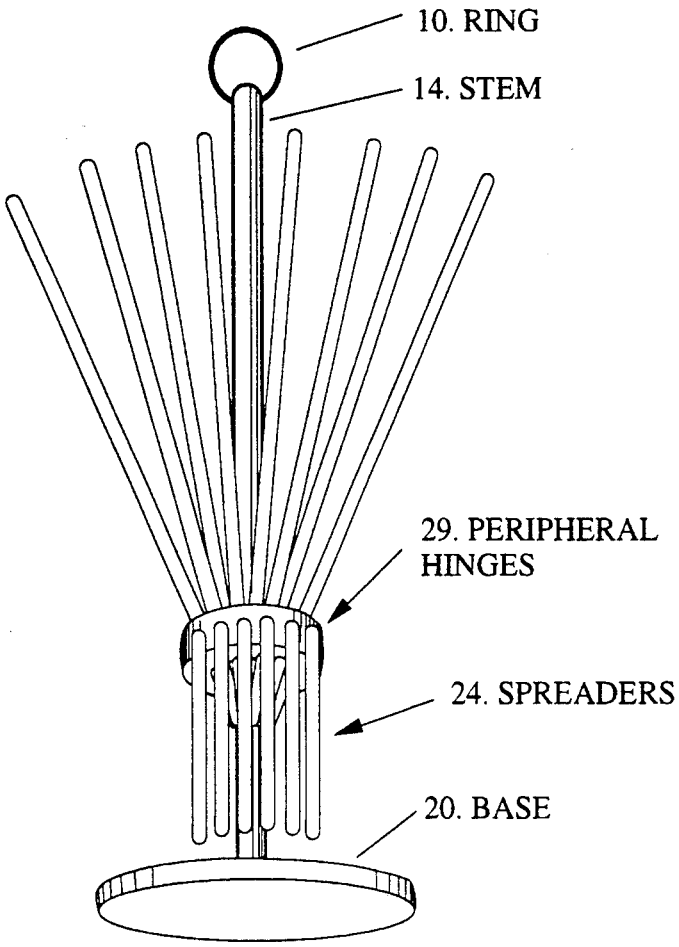
FIG. 6 shows a perspective view of embodiment 2.
Figure 7:
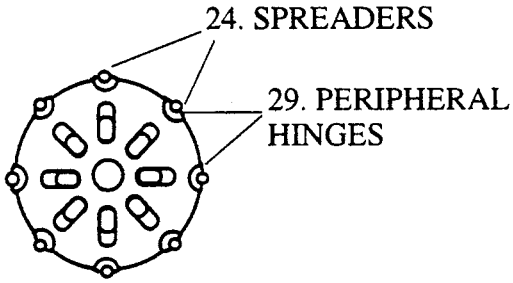
FIG. 7 shows a top view of a Dilator Ring for embodiment 2 with Spreaders attached.

FIG. 6 shows embodiment 2, which is basically embodiment 1 with the addition of Spreaders 24. There is a corresponding Spreader 24 for each Hanger 12. These Spreaders 24 are attached to the perimeter of the Dilator Ring 16 via a swinging means for attaching the spreaders, or Peripheral Hinge (29), as shown in FIG. 7. They are adapted to hold a bag open when it is hung from the Hangers 12 by swinging upwardly and resting on the lateral inner wall of the bag due to the force of gravity. There are many ways of achieving this swinging attachment. In our prototypes we drilled holes through the proximal ends of the Spreaders 24 and passed a copper wire through them, forming a hinge similar to that used for the Central Hinge 28. Anything that allows for free swinging of the Spreaders 24 in a direction parallel to the radii of the Stem 14 will work.

FIG. 8 shows a Dilator Ring 16 for embodiment 2 with Eyelets 26. In this design, the Spreaders 24 are attached to the Dilator Ring 16 via Eyelets 26 at the proximal end of the Spreader 24 and the perimeter of the Dilator Ring 16.

Figure 9:
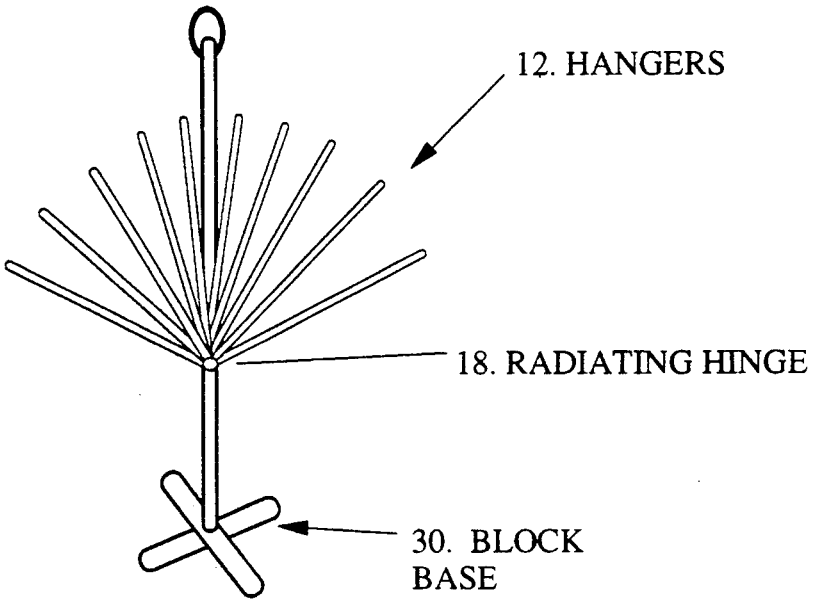
FIG. 9 shows a perspective view of embodiment 3 with a Block Base.

FIG. 9 shows embodiment 3 with a Block Base 30. This embodiment has a different hinging mechanism for the Hangers 12. The Hangers 12 all radiate outwardly from the Radiating Hinge 18 in parallel planes, as opposed to fanning out from the axis as in embodiments 1 and 2. The Radiating Hinge 18 is comprised of a pivot point which the bases of each Hanger 12 pivot around by virtue of holes drilled though their proximal ends which match the diameter of the pivot point. The bottom of each Hanger 12 has a notch which allows it to go a prescribed distance before it stops. This ensures that the Hangers 12 radiate out evenly from the Stem 14 and each other. There are various other ways of achieving the same symmetry.

Figure 10:
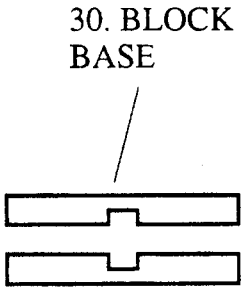
FIG. 10 shows a side view of a Block Base separated.
Figure 11:
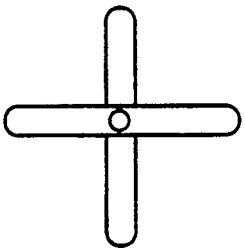
FIG. 11 shows a top view of a Block Base assembled.
Figure 12:
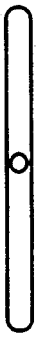
FIG. 12 shows a top view of a Folding Base folded.
Figure 13:
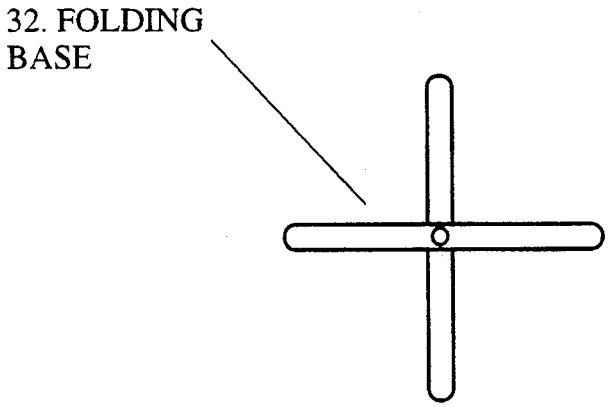
FIG. 13 shows a top view of a Folding Base unfolded.
Figure 14:
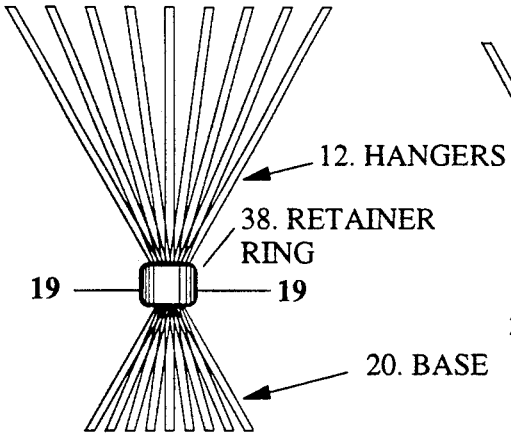
FIG. 14 shows a side view of embodiment 4b unfolded.

There a variety of ways of incorporating a removable base. The Block Base 30 illustrated in FIG. 9 comprises two blocks which are cut to fit into each other, as shown if FIG. 10. When the blocks are assembled, as shown in FIG. 11, the notch at the center of each block fits into the notch of the other block, forming a stable base. A folding Base 32 (as shown in FIG. 12 and 13) may also be incorporated. This is comprised of two pieces fastened together such that they pivot from the middle, and fold inwardly upon themselves. FIG. 12 shows a Folding Base 32 folded upon itself, while FIG. 13 shows a Folding Base 32 unfolded. Both the Folding Base 32 and the Block Base 30 have a hole in the center which the base of the Stem 14 fits into. The fit of the Stem 14 within the base should be tight, while allowing for removal of the base. One would remove the base for storage, or when hanging the Bag Dryer.

Embodiments *4a–4c*, as shown in FIGS. 14, 16 and 18–20, all have Hangers 12 which pivot tangentially relative to the axis. In all three versions, the Hangers 12 pivot at the Retainer Ring 38 via a swiveling means for pivotally attaching the hangers to the Retainer Ring 38. This pivoting motion occurs in a plane generally perpendicular to the radii of the axis. This creates a shape above the swiveling means which approximates the shape of an inverted cone, and a shape below the swiveling means which approximates the shape of an inverted cone, and a shape below the swiveling means that approximates the shape of a relatively small upright cone. The upright cone formed by the Hangers 12 serves as a stable means of supporting the Bag Dryer in a free standing position when the Hangers 12 are unfolded outwardly.

Figure 18:
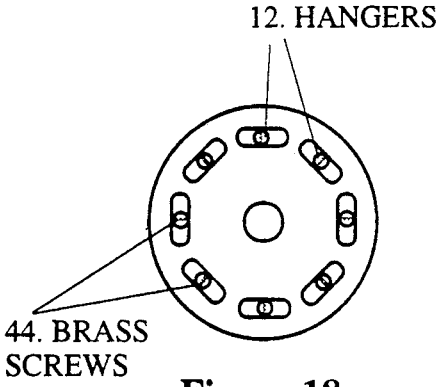
Figure 19:
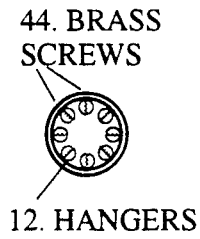
FIG. 19 shows a top view of the Retainer Ring for embodiment 4b taken along the lines 19—19 of FIG. 14.
Figure 20:
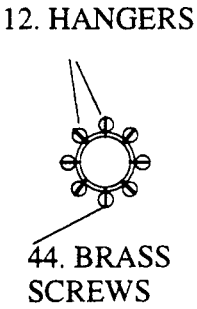
FIG. 20 shows a top view of the Retainer Ring for embodiment 4c.

There are a variety of designs for the Retainer Ring 38, as shown in FIGS. 18–20. In Version *4a*, as illustrated in FIG. 18, the Retainer Ring 38 is disc-shaped and includes a plurality of oblong holes with generally vertical axis. These holes are slightly larger in width than the diameter of the Hangers 12, and are positioned lengthwise in a circular formation with the Retainer Ring 38. In our prototypes, the swiveling means is comprised of a small hole drilled through the Hangers 12 approximately ⅔ of the way down from the top of the Hangers 12, through which a Small Brass Screw 42 or Brad is passed, securing the Hanger 12 to the Retainer Ring 38, while allowing it to pivot freely to a given point. In version *4b*, as illustrated in FIG. 19, the Retainer Ring 38 is comprised of a circular ring and a swiveling means is adapted to pivotally attach the Hangers to the inside border of the Retainer Ring 38. In version *4c*, as illustrated in FIG. 20, the Retainer Ring 38 is circular, and the swiveling means is adapted to to pivotally attach the pivotally attach the Hangers to the outside border of the Retainer Ring. In version *4b* and *4c*, the amount that each hanger radiates outwardly is dictated by the relative diameter of the Retainer Ring 38 and Hangers 12, and the number of Hangers 12 used. These parameters can be adjusted to achieve the desired angle. On our prototypes, the inside diameter of the Retainer Ring 38 for version *4b* was one inch, while the diameter of each Hanger 12 was ¼ inch. In version 4*c*, the outside diameter of the Retainer Ring was 1 inch. With 8 hangers arranged thusly, the angle of the Hangers 12 was no more than 40 degrees from the vertical with the hangers unfolded outwardly. In embodiments 4*b* and 4*c*, the Hangers 12 are attached to the Retainer Ring 38 via screws, brads, rivets, or any other swiveling means. The bottoms of the Hangers 12 can have an angle beveled into them, such that when the bag dryer is placed on a flat surface and minor downward pressure is applied, they automatically pivot away from the vertical, which allows for easy unfolding. Thus the angle at the bottom of the Hangers 12 should be the same as the angle the Hangers 12 pivot away from the vertical. This will insure that the bottoms of the Hangers 12 will rest flatly when unfolded outwardly. The point at which the Hangers 12 are attached to the Retainer Ring 38 should be approximately ⅔ down from the top of the Hangers 12. Whatever design is used must allow the Hangers 12 to pivot freely in a plane generally perpendicular to the radii of the axis.

Figure 15:
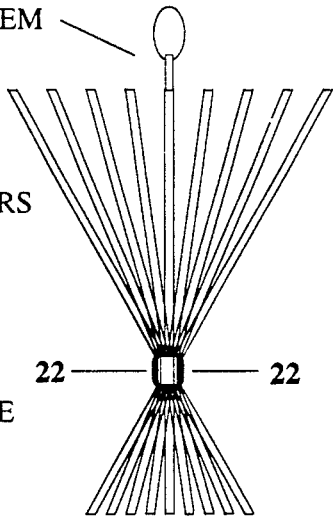
FIG. 15 shows a side view of embodiment 5 unfolded.
Figure 16:
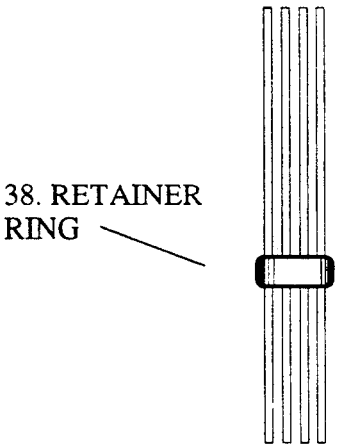
FIG. 16 shows a side view of embodiment 4b folded.
Figure 17:
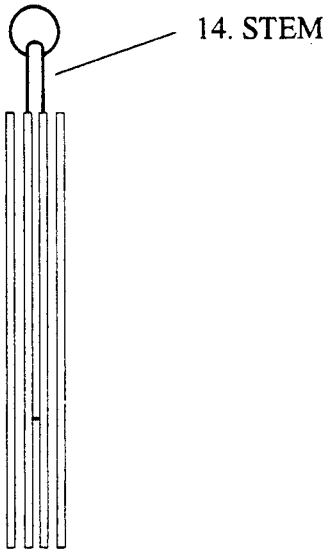
FIG. 17 shows a side view of embodiment 5 folded.
Figure 21:
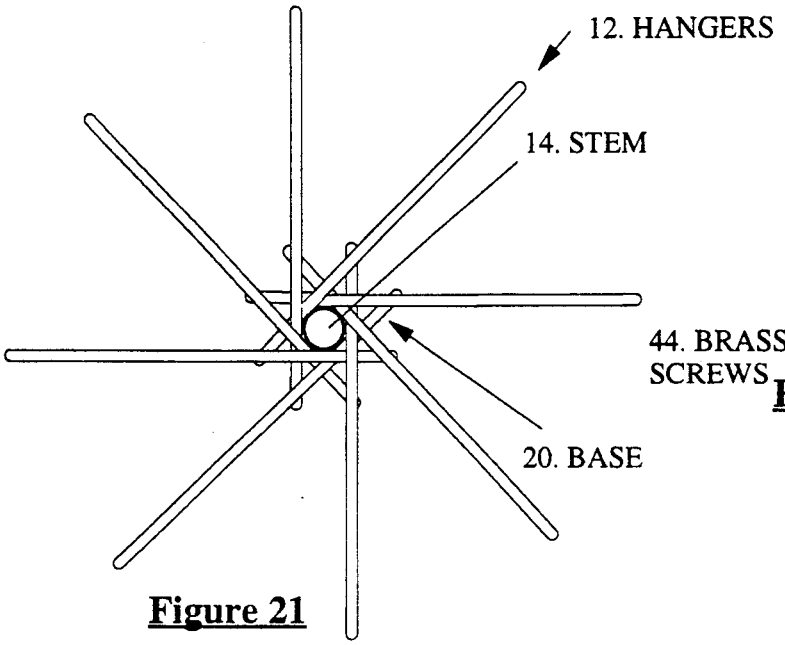
FIG. 21 shows a top view of embodiment 5 unfolded.
Figure 22:
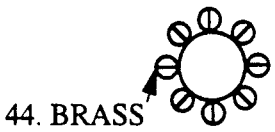
FIG. 22 shows a plan view of embodiment 5 folded taken along the lines 22—22 of FIG. 15.

Embodiment 5, as shown in FIGS. 15, 21 and 22, includes a Stem 14 which defines the vertical axis. A swiveling means for pivotally attaching the Hangers 12 to the Stem 14 at a given point allows each Hanger 12 to pivot tangentially relative to the axis in a plane generally perpendicular to the radii of the axis. Such a swiveling means may be comprised of Small Brass Screws 44, brads, or rivets which are passed through holes in the Hangers at the pivot Point. As in embodiment 4, this pivot point should be approximately ⅔ down from the top. This creates a shape above the swiveling means which approximates the shape of an inverted cone, and a shape below the swiveling means that approximates the shape of a relatively small upright cone. This upright cone of hangers serves as a stable mean s of supporting the Bag Dryer in a free standing position when the Hangers are unfolded outwardly. Also, as in embodiment 4, the angle to which the Hangers 12 unfold outwardly depends on the diameter of the Hangers 12 and Stem 14, the number of Hangers 12 used, and the angle (if any) beveled on the bottom of the Hangers 12. This embodiment allows the Plastic Bag Dryer to hang freely from the stem, or rest upon a surface.

FIG. 21 shows a top view of embodiment 5, which illustrates the relatively small cone formed by the Hangers 12 below the swiveling means, which acts as a base. FIG. 22 shows a top view of embodiment 5 folded. All the Hangers 12 are arranged parallel to the Stem 14.

Figure 23:
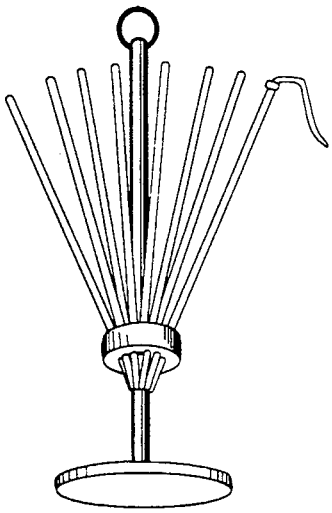
FIG. 23 shows a perspective view of embodiment 1 with a Flexible Hanger Attachment.
Figure 24:
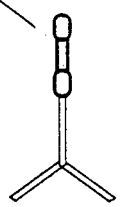
FIG. 24 shows a side view of a Flexible anger Attachment of a different shape.

There are a multitude of shapes that the ends of the Hangers 12 may take. FIG. 23 shows embodiment 1 with a Flexible Hanger Attachment 36 removably attached to the distal end of a Hanger 12. The Flexible Hanger Attachment 36 can be made from a variety of materials, including plastic and alloys. The only requirement is that is should be resilient enough to withstand continued flexing. It should be shaped such that it can be removably attached to the distal end of the Hangers 12, which allows for easy conversion back and forth. The shape of its distal end should be designed to keep the sides of the bag separated. FIG. 24 show one such permutation. The ends of all Hangers 12 or Flexible Hanger Attachments 36 should all have blunt tips, in order to prevent accidental eye injury.

Figure 25:
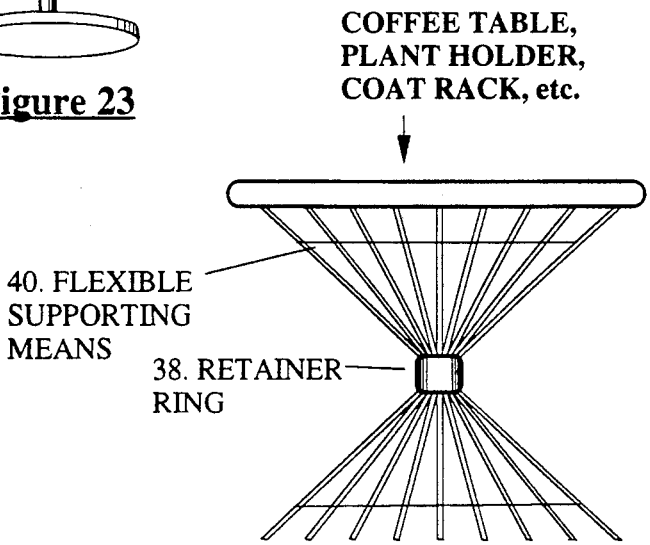
FIG. 25 shows a side view of a Foldable Support.

FIG. 25 shows a Foldable Support. It's similar to embodiment 4, but larger, with the Retainer Ring 38 placed toward the center, and a Flexible Supporting Means 42 at the top and/or bottom of the Hangers 12. The flexible Supporting Means 42 must be a strong but flexible line, similar to high-test fishing line. It passes through holes toward the ends of each hanger 12 and is secured on both sides thereof. This serves to dramatically increase the weight-bearing capability of this version, as it limits movement of the Hangers 12 both laterally and outwardly. The Retainer Ring 38 and means of securing the Hangers to the Retainer Ring must be of sufficient strength to support significant weight.

From the description above, a number of advantages of our Foldable Bag Dryer become evident:

(a) Our Foldable Bag Dryer is compact and easy to store.
(b) Our Foldable Bag Dryer is aesthetically pleasing.
(c) Our Foldable Bag Dryer is adjustable, and can be used to dry many bags concurrently.
(d) Our Foldable Bag Dryer can be used with sizes of bags.
(e) Our Foldable Bag Dryer mixes form and function, and comes in a variety of embodiments.
(f) The design of our Foldable Bag Dryer can be adapted to other uses.

OPERATION—FIGS. 1-25

Since form follows function, all the embodiments listed herein are inherently easy to use, requiring very few instructions. A Bag is placed over one or more hangers in a inverted position, such that excess water drips out and all surfaces of the bag are exposed to air. If the bag is thin-walled and inclined to stick together, it may be placed over two or more hangers in order to spread it out, and/or embodiment 2 may be used.

In order to unfold embodiments 1 and 2 outwardly, one simply grasps the Dilator Ring 16, pulling it down toward the Central Hinge 28 until it stops. At this point, the distal ends of the Hangers 12 will be furthest away from the Stem 14, while the proximal ends remain fixed to the the Stem 14 via the Central Hinge 28.

In embodiment 2, the Spreaders 24 are included to provide an extra means of keeping the bag open to maximize air-drying. Once the bag is placed over the Hanger 12 so that the mouth of the bag is facing downward, the corresponding Spreader 24 is swung upwardly and placed within the bag, so that it rest against the lateral inner wall of the bag due to gravity.

In embodiment 3 (as shown in FIG. 9) the Hangers 12 fan out from the Radiating Hinge 18 in one axis, so that folding it is a matter of pushing the Hangers 12 toward the Stem 14, while spreading the Hangers 12 involves pulling them out from the Stem 14.

In embodiments 4*a*–4*c* (as shown in FIGS. 14, 16 and 18–20), one grasps the Retainer Ring 38 while rotating it around it's axis. Centrifugal force makes the hangers 12 fan out. It can also be unfolded by merely resting it on a flat surface and applying mild downward pressure. This causes the hangers to fan out away from the vertical due to the beveled hanger bottoms. To fold it up, one squeezes the hangers 12, while rotating the Retainer Ring 38 the other direction.

Embodiment 5 folds outwardly and inwardly in a similar fashion. When the stem is rotated, the Hangers fan out due to centrifugal force. It can also be unfolded by merely resting it on a flat surface and applying mild downward pressure to the Stem 14.

The Foldable Support (as shown in FIG. 25) may be used to support various articles, while still folding compactly towards it's center, similar to embodiments 4 and 5. These could be sold as generic support devices, supporting anything from coffee tables to plants, while being foldable, lightweight, and esthetically pleasing.

SUMMARY, RAMIFICATIONS, AND SCOPE

Although the description above contains many specificities, these should not be construed as limiting the scope of the invention, but as merely providing illustrations of some of the presently preferred embodiments of this invention. The Foldable Bag Dryer may be made of many different materials. The shapes of all the components listed may vary greatly, as long as they all serve the same function. Many different models could be manufactured, according to aesthetic tastes and financial concerns. The mechanism of hanging the Plastic Bag Dryer can vary greatly, depending on what it will be hung on. A variety of bases may be incorporated, depending on aesthetic preferences, space restrictions, and packing demands. The means of attaching the hangers to the retainer ring or stem may vary considerably, as long as they allow for free pivoting action. The Foldable Support illustrated in FIG. 25 may vary greatly in size, and be made to support various types of weight. Thus the scope of our invention should be determined by the appended claims and their legal equivalents, rather than by the examples given.

We claim:

1. A compact upright folding bag dryer for use with at least one bag comprising:

a vertical upright substantially round elongated stem, said stem defining a central axis;

a plurality of elongated hangers having ends that are proximal and distal to said central stem, a hinging means attaching the distal ends of said hangers to the bottom portion of said stem, a single one-piece securing means having a plurality of elongated holes, each hole supporting and surrounding an individual hanger and a central hole means passing through said securing means for slideable engagement along the length of said central stem, wherein as the securing means is slid toward the hinging means the hangers are caused to unfold outwardly away from said stem, whereby in such position, said at least one bag is placed over a plurality of hangers in an inverted position with a substantial portion hanging therefrom and located with adequate clearance from said hangers in order to optimize air circulation, as the securing means is slid away from the hinging means the hangers are caused to fold inwardly toward said stem in a compact and portable arrangement.

* * * * *